US005661955A

United States Patent [19]

Maida et al.

[11] Patent Number: 5,661,955

[45] Date of Patent: Sep. 2, 1997

[54] CASE FOR EXPANDABLE PACKING MATERIAL

[75] Inventors: Richard C. Maida, Staten Island; Joseph Sferlazza, West Hempstead, both of N.Y.

[73] Assignee: Prompac Industries, Inc., Staten Island, N.Y.

[21] Appl. No.: 522,675

[22] Filed: Sep. 1, 1995

[51] Int. Cl.[6] ..... B65B 23/00; B65B 53/00

[52] U.S. Cl. ..... 53/441; 53/465; 53/472

[58] Field of Search ..... 493/966, 967; 206/215, 494, 594, 584, 521; 229/87.02; 53/461, 465, 445, 474, 139.5, 441, 48.4, 48.3

[56] References Cited

U.S. PATENT DOCUMENTS

| | | | |
|---|---|---|---|
| 487,026 | 11/1892 | Cummings | 206/494 X |
| 2,029,245 | 1/1936 | Lyon | 206/494 X |
| 3,225,509 | 12/1965 | May | 53/397 |
| 3,612,264 | 10/1971 | Trunick | 206/494 |
| 3,793,799 | 2/1974 | Howe | 53/461 |
| 4,004,685 | 1/1977 | Mizuno | 206/460 X |
| 5,001,017 | 3/1991 | Alhamad | 428/573 |
| 5,040,696 | 8/1991 | Liebel | 206/521 |
| 5,500,037 | 3/1996 | Alhamad | 206/521 X |

*Primary Examiner*—Linda Johnson
*Attorney, Agent, or Firm*—Scully, Scott, Murphy & Presser

[57] ABSTRACT

A package of expandable wrapping material, and a method of using that package. The package comprises a folder and a supply of sheets of expandable paper material connected to the folder. To use a sheet, the folder is opened, and a user grips the bottom edge of one of the sheets and stretches that sheet. As it is stretched, the sheet expands into a three-dimensional shape. The desired amount of expanded material is formed, and then that expanded material may be cut or torn from the folder. The expanded material may be used to wrap an article, either while that expanded material is still attached to the folder, or after that material is torn from the folder. Also, the expanded material may be used to fill voids or cavities in a box or container. Preferably, the package is secured to a fixed location, such as a work surface or a holder, while a sheet is stretched and cut or torn from the folder, and the package may be provided with means to facilitate attaching the folder to this fixed location.

9 Claims, 4 Drawing Sheets

CASE FOR EXPANDABLE PACKING MATERIAL

BACKGROUND OF THE INVENTION

This invention generally relates to expandable wrapping material. More specifically, the invention relates to a case or package for such wrapping material, and to a method for handling and using expandable wrapping material.

Cushioning or filler materials are often used to protect articles that are being shipped or transported. For instance, an article may be wrapped in a cushioning material and then placed in an envelope or box for shipment. Alternatively, an article inside a box or package may be surrounded by a cushioning or filler material to cushion the article during transportation.

Conventional packing materials have several important disadvantages. For example, small, peanut-shaped styrofoam pieces and flat plastic sheets impregnated with a multitude of bubbles are commonly used as packing materials. Toxic wastes are produced, however, when these materials are made. In addition, the disposal of these packing materials has become a significant environmental problem. In particular, these materials are not biodegradable; and these packing materials, particularly the styrofoam peanuts, are bulky and it is not generally practical to store these items for reuse. Crumpled newspapers may also be used as a packing material; however, newspapers are often not very effective for this purpose.

Recently, attention has been directed to using an expandable paper as a packing material. This paper has a multitude of slits that are shaped and positioned such that when the paper is stretched, it is pulled into a three dimensional honeycomb shape. In this shape, the expanded paper material is both load bearing and resilient, and the paper makes an excellent cushioning and packing material.

Commonly, this paper material has been sold in the form of flat sheets, or as a roll of the unstretched material. The material is then stretched and expanded by a user, usually at the specific time and location at which it is used.

SUMMARY OF THE INVENTION

An object of this invention is to improve packages and packaging for expandable packing material.

Another object of the present invention is to package expandable paper material in a folder that may be used to help stretch the paper material.

A further object of this invention is to improve procedures for stretching expandable wrapping or cushioning material.

Still another object of the present invention is to provide a novel procedure for expanding an expandable paper material, either to wrap an article in the expanded paper material, or to fill voids or cavities in shipping boxes.

These and other objectives are attained with a package of expandable wrapping material, and a method of using that package. The package comprises a folder and a supply of sheets of expandable paper material connected to the folder. To use a sheet, the folder is opened, and a user grips the bottom edge of one of the sheets and stretches that sheet. As it is stretched, the sheet expands into a three-dimensional shape. The desired amount of expanded material is formed, and then that expanded material may be cut or torn from the folder. The expanded material may be used to wrap an article, either while that expanded material is still attached to the folder, or after that material is torn from the folder. Also, the expanded material may be used to fill voids or cavities in a box or container.

Preferably, the folder is secured to a fixed location while a sheet is stretched and cut or torn from the folder. This eliminates the need for the user to hold the folder while a sheet is being stretched, allowing the user to use both hands to grip and stretch the sheet. This fixed location may be, for example, a work table, a wall or a holder. Preferably, the package is provided with means to facilitate attaching the folder to this fixed location, and, for example, this attaching means may include first and second strips of hook and fastener material. These strips are, initially, connected to the folder in a manner that allows them to be easily detached or removed. To use these strips, they are first detached from the folder, the first strip is attached to a work surface, the second strip is attached to the back of the folder, and the two strips are then attached to each other, effectively securing the folder to the work surface.

Further benefits and advantages of the invention will become apparent from a consideration of the following detailed description given with reference to the accompanying drawings, which specify and show preferred embodiments of the invention.

DETAILED DESCRIPTION OF THE PREFERRED EMBODIMENT

Figure 1:
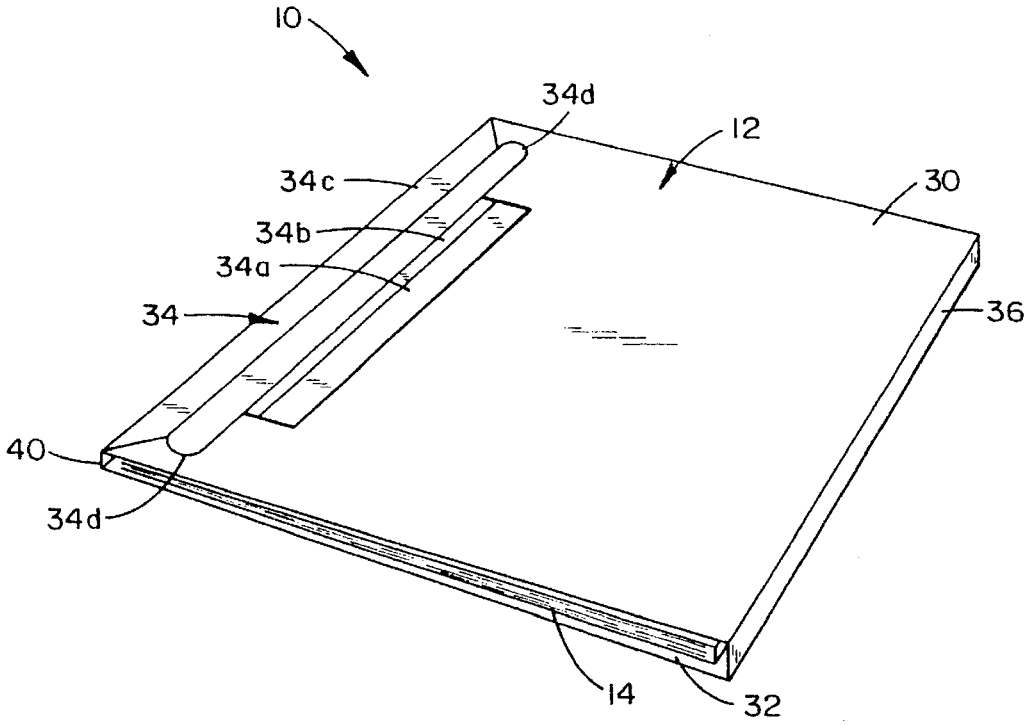
FIG. 1 is a perspective view of a package of expandable paper material and embodying the present invention.
Figure 2:
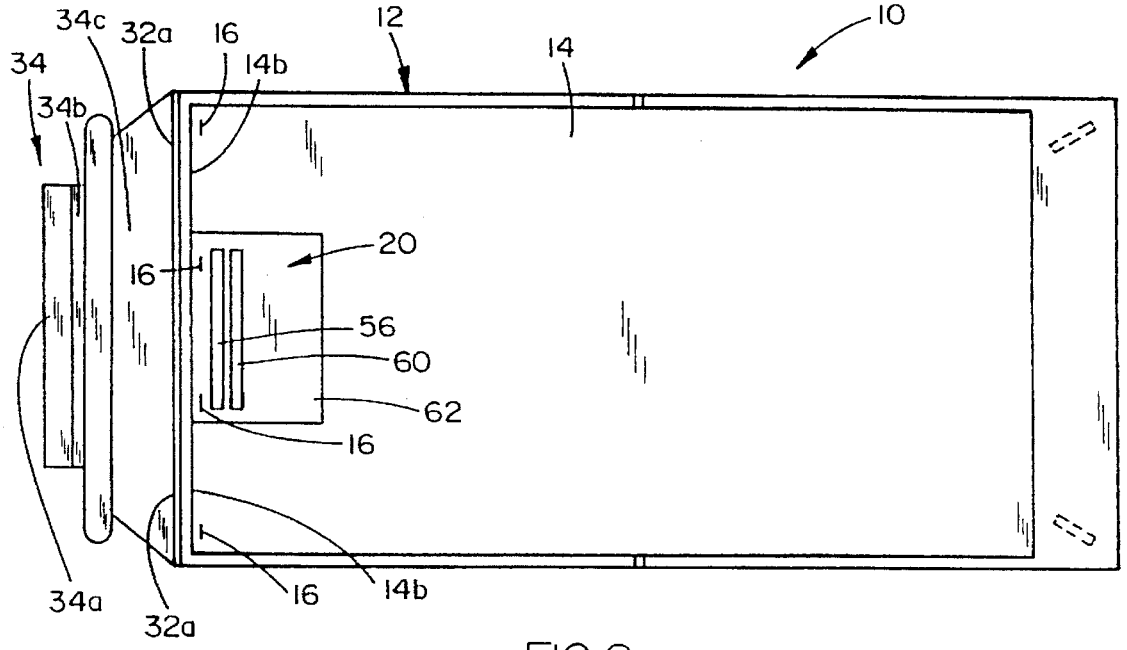
FIG. 2 is a plan view of the package of FIG. 1, with the package in an open position.
Figure 3:
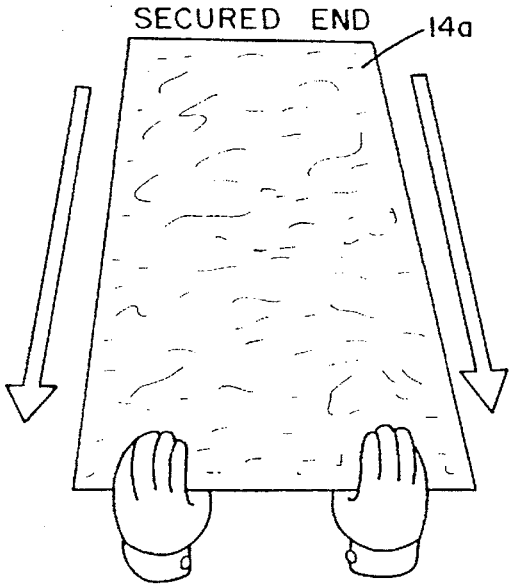
FIGS. 3–6 generally illustrate a procedure for pulling and using a sheet of expandable material from the package of FIGS. 1 and 2.

FIGS. 1 and 2 illustrate package 10 generally comprising folder 12 and a supply of sheets 14 of expandable paper material. Preferably, package 10 also includes connecting means 16 and attaching means 20. Generally, sheets 14 are disposed in and secured to folder 12, which forms a protective cover or envelope for sheets 14. To remove sheets 14 from folder 12, the folder is opened, as shown in FIG. 2; and, with reference to FIGS. 3–6, a user grips the bottom edge of the top sheet **14*a* and stretches that top sheet. As it is stretched, the sheet 14*a*, starting from its bottom edge, expands into a three-dimensional honeycomb shape, as illustrated at 22 in FIG. 4; and as the user continues to stretch sheet 14*a*, an increasing area or length of the sheet expands into that honeycomb shape. The user continues to stretch sheet 14*a* until the desired amount of honeycomb material is formed, and then that amount of material may be cut or torn from folder 12**. A user need only expand as much material as may be required for a specific application. This may be, for example, one complete sheet of material, less than one complete sheet, or more than one sheet.

Preferably, folder 12 is secured to a fixed location while sheet **14*a* is stretched and cut or torn away from the folder. This eliminates the need for the user to hold folder 12 while sheet 14***a* is being stretched, allowing the user to use both hands to grip and stretch the sheet. This fixed location may be, for example, a work table, a wall, or other suitable surface or holder.

The honeycomb material 22 formed by stretching sheet 14*a* may be used in many ways and for many purposes. For instance, that material may be wrapped around an article, as generally illustrated at 24 FIG. 5, or the honeycomb material may be used to fill voids or cavities in a box or container that is being used to ship an article, as generally illustrated at 26 in FIG. 6. Also, if the honeycomb material is used to wrap an article, that article may be wrapped with the honeycomb material before or after that material is torn or cut from folder 12.

Figure 7:
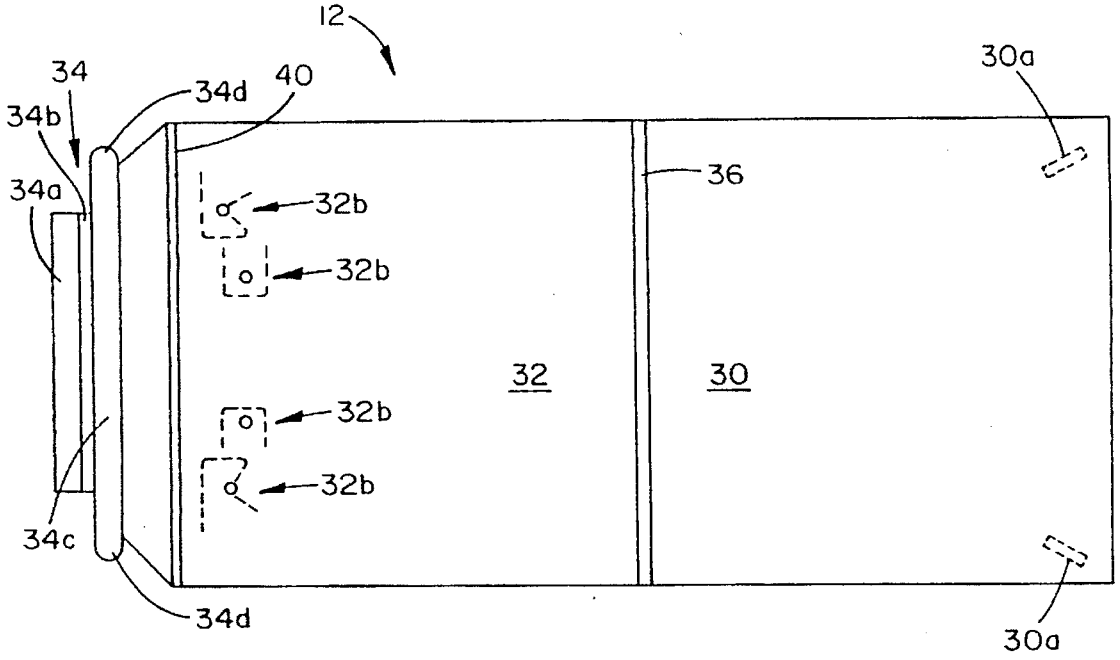
FIG. 7 is a top plan view of a folder of the package shown in FIGS. 1 and 2.

FIG. 7 illustrates folder 12 in greater detail; and, generally, the folder includes top section 30, bottom section 32, flap 34 and fold sections 36 and 40. More specifically, as shown in FIG. 7, top section 30 is located on the right side of the folder, flap 34 is located on the left side, and bottom section 32 is located between the flap and the top section. Fold section 36 separates top section 30 from bottom section 32 and also foldably connects together these two sections. Similarly, fold section 40 separates flap 34 from bottom section 32 and also foldably connects together the flap and the bottom section.

With the above-described arrangement, folder 12 has open and closed positions. In the closed position, shown in FIG. 1, top section 30 is folded over bottom section 32; and in the open position, shown in FIG. 2, top sections 30 extends outward from and is generally coplanar with bottom section 32.

Preferably, in its open position, folder 12 has a generally rectangular shape, and fold sections 36 and 40 transversely extend across the folder. Further, with the embodiment of folder 12 shown in the drawings, top and bottom sections 30 and 32 have substantially the same size and shape. In this way, when top section 30 is folded over bottom section 32, the former section covers the latter section.

Flap 34 is provided to hold folder 12 in the closed position. More specifically, flap 34 is foldably connected to bottom section 32 via folding section 40. When folder 12 is in the closed position—that is, with top section 30 folded over bottom section 32—flap 34 may be folded over and connected to the top section to hold the top section in that closed position. To open folder 12, flap 34 is disconnected from and folded away from top section 30, and that top section itself is then folded away from bottom section 32.

Any suitable means or procedure may be used to connect flap 34 to top section 30 to hold folder 12 in the closed position. Preferably, package 10 is designed and constructed so that flap 34 is more securely attached to top section 30 when package 10 is initially made; and then, after the package is sold and first opened by a user, flap 34 may be more readily connected to and disconnected from top section 30.

For example, when package 10 is made or assembled, the distal end or end portion 34*a* of flap 34 may be glued to top section 30 to hold folder 12 in its closed position. In addition, flap 34 may be provided with a tear strip 34*b* that extends along the complete length of the flap; and folder 12 may be initially opened by a purchaser or consumer by tearing flap 34 along tear strip 34*b*, and then folding the proximal portion 34*c* of the flap away from top section 30.

Furthermore, preferably the lateral ends of the proximal portion of flap 34 form tabs or ear portions 34*d*, and top section 30 forms a pair of slits 30*a* for receiving these tabs 34*d*. After package 10 is initially opened, flap 34 may be reconnected to top section 30 by folding the flap over that top section and inserting tabs 34*d* into slits 30*a*. Folder 12 may then be reopened by pulling tabs 34*d* out of slits 30*a*, and folding flap 34 away from top section 30.

As will be understood by those of ordinary skill in the art, folder 12 may be made from any suitable material and in any appropriate manner. For example, folder 12 may be made from a single piece of cardboard that is cut into the desired shape and provided with fold sections 36 and 40 to separate that cardboard piece into flap 34, bottom section 32 and top section 30.

Figure 8:
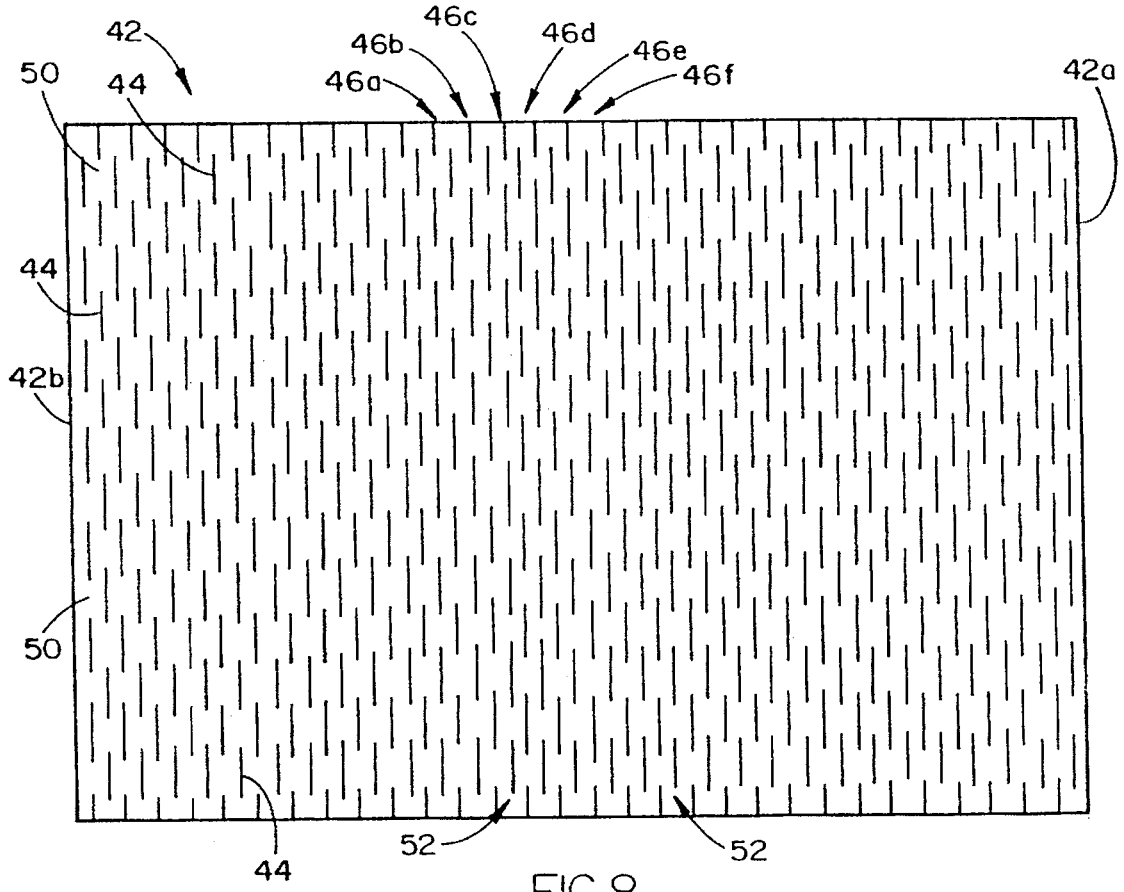
FIG. 8 is a top plan view of a portion of a sheet of expandable material from the package of FIGS. 1 and 2.

The individual sheets in package 10 are substantially identical to each other, and FIG. 8 shows in greater detail a section of one of the sheets of the expandable paper material, generally referenced at 42. Sheet 42 is comprised of a paper or paper like-material and has a multitude of slits 44 arranged in a multitude of parallel rows. Six of these rows are referenced at 46*a*, 46*b*, 46*c*, 46*d*, 46*e*, and 46*f* in FIG. 8. These slits 44 are positioned so that the slits of one row extend across the intervals or spaces between the slits of the adjacent row, producing a staggered arrangement of slits over sheet 42. Preferably, all of the slits 44 have the same length. In addition, along the transverse axis of sheet 42, the slits 44 are uniformly spaced apart; and along the longitudinal axis of sheet 42, the rows of slits are also uniformly spaced apart.

With the above-described arrangement, sheet 42 forms a short land 50 between each pair of transversely adjacent slits 44, and a land 52 between each pair of adjacent rows of the slits. Preferably, all of the lands 50 have the same length $d_1$, and all of the lands 52 have the same width $d_2$.

Although preferably all of the slits 44 have the same length, that length may vary over a wide range. Similarly, although the slits 44 are uniformly spaced apart a distance $d_1$, and the rows of slits are uniformly spaced apart a distance $d_2$, those distances $d_1$ and $d_2$ may also vary over wide ranges. For example, with the embodiment of sheet 42 shown in FIG. 8, the slits 44 are one half inch long, adjacent slits are transversely spaced apart three sixteenths of an inch, and the rows of slits are spaced apart one eighth inch. As will be understood by those of ordinary skill in the art, other specific dimensions may be chosen.

Figure 4:
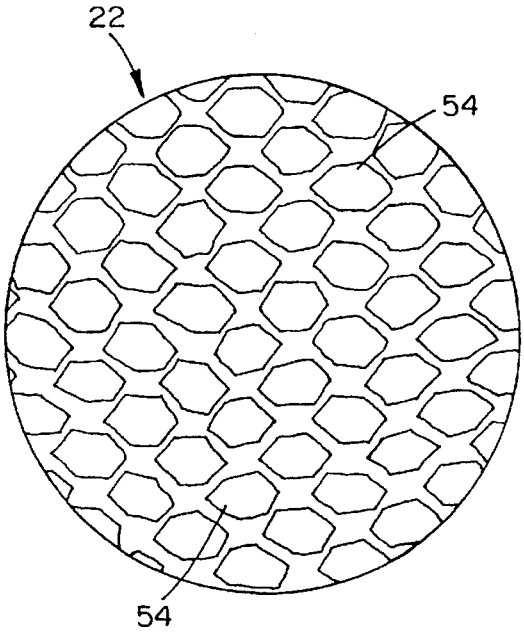
Figure 5:
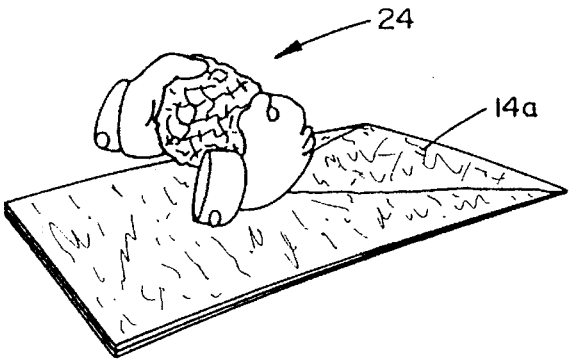
Figure 6:
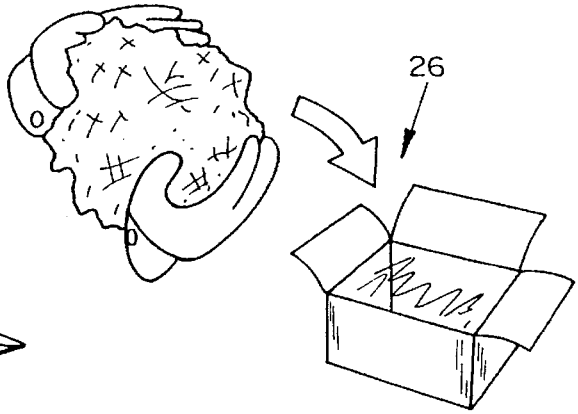
Figure 9:
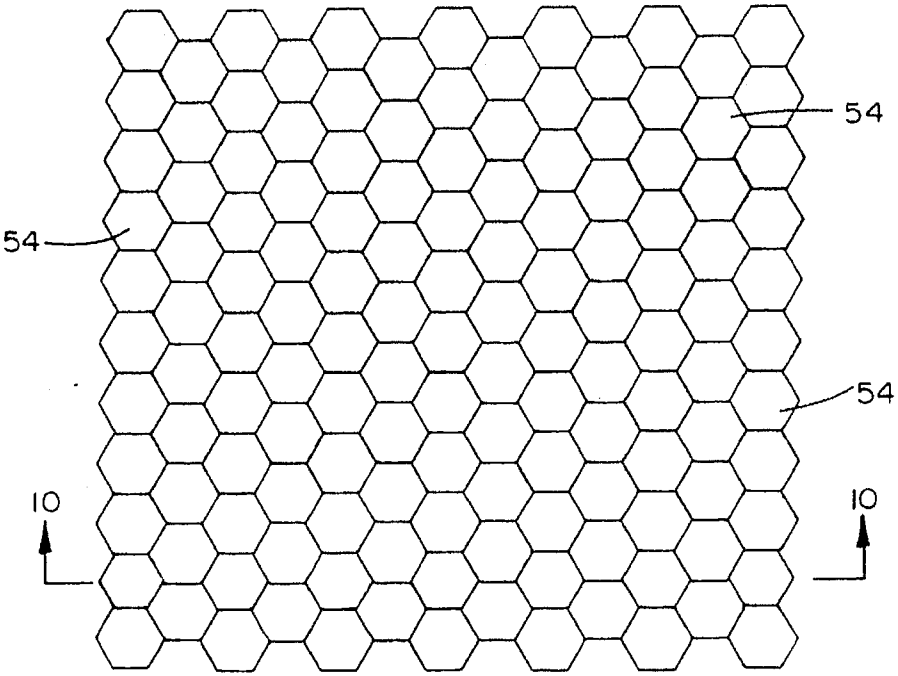
FIG. 9 is a top view of a portion of the material shown in FIG. 8 after that material has been expanded into a three-dimensional shape.
Figure 10:
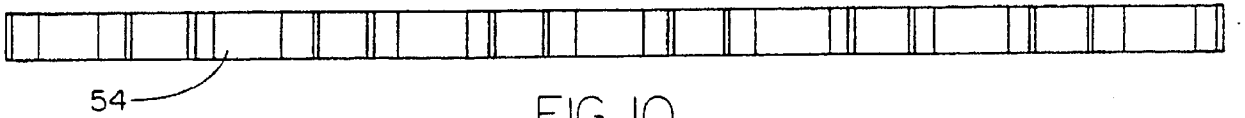
FIG. 10 is a cross sectional view taken along line 10—10 of FIG. 9.

Slits 44 are provided in sheet 42 to allow that sheet to be pulled into a three-dimensional shape comprised of a multitude of hexagonal cells 54 as shown in FIGS. 4 and 9. More specifically, with reference to FIGS. 8 and 9, to pull sheet 42 into this shape, opposite edges 42*a* and 42*b* are pulled apart along the longitudinal axis of the sheet. As this happens each slit 44 is pulled open into a hexagonal cell 54; and the land segments 50 on opposite sides of each slit 44 are pulled apart, twisted into a direction approximately 45° to the original plane of sheet 42 and also pulled into a shape forming the sides of the hexagonal cell formed from the slit.

Sheet 42 may be made of a multitude of types of materials. The important consideration is that when the material is provided with slits 44 and then pulled in a direction perpendicular to the direction of the lengths of those slits, the material expands into a three-dimensional shape that is both resilient and load bearing and comprised of a multitude of open cells 54. Preferably, this material is a fibrous, paper material, and sheet 42 is very well designed to be made from recycled paper. For instance, sheet 42 may be a paper material of the type referred to as a zero nip stock, which contains strong, bulky fibers. The strength and weight of the material of sheet 42 may vary over wide ranges, though. It is preferred that the lengths of the slits 44 be perpendicular to the direction of the grain of sheet. Sheet 44 may be made in any appropriate manner; and, for example, one acceptable procedure for making sheet 44 is disclosed in U.S. Pat. No. 5,365,819, the disclosure of which is hereby herein incorporated by reference.

Also, the individual sheets of package 10 can have substantially identical lengths and widths. Preferably, the width of sheets 14 is slightly smaller than the width of folder 12 and the length of sheets 14 is slightly smaller than the sum of the lengths of the bottom and top sections 32 and 30. In this way, when folder 12 is open, the sheets 14 may be stacked one on top of another, and this stack may be placed on bottom and top sections 32 and 30. Also, this stack of sheets 14 may be folded in half, about a line extending across the width of the stack, and top section 30 may then be folded over the top of the stack such that the folded stack of sheets fits inside folder 12, and the top and bottom halves of the folded stack are fully covered by top and bottom sections 30 and 32, respectively, of the folder.

To form package 10, folder 12 is opened and a stack of sheets 14 is connected to the folder. Preferably, these sheets are positioned with the top edge **14*b* of stack 14 parallel to and closely adjacent top edge 32*a* of back section 32. Also, any suitable means may be used to connect sheets 14 to folder 12; and, for example, a series of staples may be used to staple those sheets to folder 12, closely adjacent top edge 14*b*** of the stack of sheets.

After sheets 14 are attached to folder 12, sheets 14 are folded in half, and specifically, the lower half of the stack of sheets 14 is folded over and onto the upper half of the stack. Then, top section 30 is folded over and onto the folded stack of sheets, and flap 34 is folded over and secured to the outside surface of top section 30.

To open package 10, tear strip **34*b* of flap 34 is torn away from the flap, the proximal portion 34*c* of the flap is folded away from top section 30, and that top section is folded away from the stack of sheets 14. That stack itself may then be unfolded, so that each sheet in the stack is unfolded into a generally flat, planar shape. The sheets of expandable material may then be expanded and cut or torn away from the folder 12**.

After the desired amount of expandable material has been taken from folder 12, the folder may be closed. This may be done by refolding the remaining sheets of stack 14, folding top section 30 back over the folded stack, and folding the proximal portion of **34*c* of flap 34 back over, and connecting the flap to, the top of top section 30. For instance, that flap may be connected to top section 30 by inserting tabs 34*d* into slits 30*a***.

Preferably, as mentioned above, when the sheets are removed from folder 12, the folder is secured to a fixed location, such as a work table or a work surface. This may be done at any suitable time; and, in particular, folder 12 may be secured to that location either before or after the folder is opened.

Folder 12 may be secured to this fixed location in any appropriate manner. Preferably, however, package 10 is provided with attaching means 20 to facilitate securing folder 12 to a fixed location; and with the preferred embodiment of package 10 described herein in detail, attaching means 20 includes first and second strips 56 and 60 of hook and fastener material. These strips 56 and 60 are connected to folder 12 in a manner that allows them to be easily detached or removed; and, for example, these strips 56 and 60 may be attached to a small piece of paper 62 that is placed on top of stack 14 and connected to folder 12 with stack 14 by means of staples 16.

To use strips 56 and 60, they are first detached from folder 12. Strip 56 is attached to a suitable work surface, such as a work table; second strip 60 is attached to the back of folder 12; and strips 56 and 60 are attached to each other, effectively securing folder 12 to that work surface. Preferably, in order to secure folder 12 to this work surface, strip 60 is attached to the back of bottom section 32, adjacent the top edge **32*a* thereof. Further, strips 56 and 60 may be attached to this work surface and to folder 12 in any suitable manner; and, for instance, these strips 56 and 60** may be secured in place by an adhesive or by an adhesive tape.

Other means may be provided, as substitutes for or in addition to attaching means 20, to help secure folder 12 to a given location. For example, many offices have a supply room that contains supplies for, among other things, wrapping and mailing packages. These supply rooms often have comparatively standard hooks or holders for holding paper dispensers. Back section 32 may be provided with various sets of score lines **32*b*, with each set of score lines used to form a pair of openings in the back section for mounting folder 12** on a respective one standard type of holder or set of hooks.

While it is apparent that the invention herein disclosed is well calculated to fulfill the objects previously stated, it will be appreciated that numerous modifications and embodiments may be devised by those skilled in the art, and it is intended that the appended claims cover all such modifications and embodiments as fall within the true spirit and scope of the present invention.

What is claimed is:

1. A method of using a package of expandable wrapping material, the package including a folder and a plurality of sheets of expandable material disposed in the folder, each of said sheets being connected to the folder and being expandable from a relatively thin shape into an expanded three-dimensional shape, the method conprising:

securing the folder to a fixed location;

opening the folder;

stretching at least a portion of one of said sheets into the three-dimensional shape, while said one sheet is connected to the folder;

wrapping an article with said stretched portion of said one sheet while said one sheet is connected to the folder; and tearing at least said portion of said one sheet from the folder.

2. A method according to claim 1, wherein the package further includes first and second strips of hook and fastener material detachably connected to the folder, and the securing step includes the steps of:

removing the first strip from the folder;

attaching the first strip to the fixed location; and attaching the second strip to the first strip.

3. A method according to claim 1, wherein each of said sheets includes opposite first and second edges, the first edges of the sheets are attached to the folder, and the stretching step includes the step of gripping the second edge of said one sheet.

4. A method according to claim 1, wherein the folder includes a plurality of score lines, each of the score lines extending along a respective area, and the securing step includes the steps of:

tearing said score lines to form a plurality of openings in the folder; and inserting a holder through said openings to mount the folder on the holder.

5. A method of wrapping an article with an expandable wrapping material, wherein the wrapping material is secured in a folder and is expandable from a flat, planar shape into a three-dimensional honeycomb shape, the method comprising:

attaching a first end of the wrapping material to a fixed location by securing the folder to the fixed location;

gripping a second end of the wrapping material;

pulling on the second end of the wrapping material to stretch at least a portion of the wrapping material into the three-dimensional shape;

wrapping the article with said stretched portion of the wrapping material while said stretched portion is connected to the folder; and tearing said stretched portion of the wrapping material from the folder.

6. A method according to claim 5, wherein the wrapping step includes the step of maintaining tension on the stretched portion of the wrapping material while wrapping the article with said stretched portion.

7. A method according to claim 5, wherein the pulling step includes the step of continuing to pull on the second end of the wrapping material to increase the size of the portion of the wrapping material that is stretched into the three-dimensional honeycomb shape.

8. A method according to claim 5, wherein:

the pulling step includes the step of stretching a desired amount of the wrapping material into the three-dimensional honeycomb shape; and the tearing step includes the step of tearing the stretched wrapping material away from the fixed location after the desired amount of the wrapping material has been stretched into the three-dimensional honeycomb shape.

9. A method according to claim 8, wherein the wrapping material is secured to a first end of the folder, and the step of securing the folder to the fixed location includes the step of securing the first end of the folder to said fixed location.

* * * * *